US006945427B2

(12) United States Patent
Hieb

(10) Patent No.: US 6,945,427 B2
(45) Date of Patent: Sep. 20, 2005

(54) SELF-LEARNING DEPTH LOGIC FOR MULTI-DEPTH VENDOR CONTROL

(75) Inventor: Larry E. Hieb, Fresno, CA (US)

(73) Assignee: The Vendo Company, Fresno, CA (US)

( * ) Notice: Subject to any disclaimer, the term of this patent is extended or adjusted under 35 U.S.C. 154(b) by 203 days.

(21) Appl. No.: 10/636,032

(22) Filed: Aug. 7, 2003

(65) Prior Publication Data

US 2004/0124201 A1 Jul. 1, 2004

Related U.S. Application Data

(60) Provisional application No. 60/401,958, filed on Aug. 8, 2002.

(51) Int. Cl.[7] ..... G07F 11/00

(52) U.S. Cl. ..... 221/10; 221/241

(58) Field of Search ..... 221/242, 241, 221/131, 124, 9, 10, 6, 59.3, 59.4; 312/42, 45, 72; 211/59.2, 59.1

(56) References Cited

U.S. PATENT DOCUMENTS

| | | | | |
|---|---|---|---|---|
| 3,556,345 | A | 1/1971 | Rowekamp | 221/242 |
| 3,674,175 | A | 7/1972 | Jaquish | 221/92 |
| 3,684,131 | A | 8/1972 | Kurimsky | 221/242 |
| 3,753,514 | A | 8/1973 | Naguet | 221/129 |
| 3,757,998 | A | 9/1973 | Millies et al. | 221/242 |
| 3,883,038 | A | 5/1975 | Bookout | 221/67 |
| 3,967,175 | A | 6/1976 | Turley | 318/258 |
| 4,096,969 | A | 6/1978 | Ragusa | 221/199 |
| 4,126,217 | A | 11/1978 | Bock | 194/291 |
| 4,168,784 | A | 9/1979 | Heier | 221/125 |
| 4,254,892 | A | 3/1981 | Lee | 221/90 |
| 4,727,798 | A | 3/1988 | Nakamura | 99/323.9 |
| 4,757,915 | A | 7/1988 | Albright et al. | 221/75 |
| 4,846,367 | A | 7/1989 | Guigan et al. | 221/81 |
| 4,940,161 | A | 7/1990 | Hieb | 221/67 |
| 4,986,615 | A | 1/1991 | Hieb et al. | 312/45 |
| 5,127,546 | A | 7/1992 | Chen | 221/242 |
| 5,320,025 | A | 6/1994 | Ikari | 91/459 |
| 5,404,797 | A | 4/1995 | Millar | 99/357 |
| 5,511,646 | A | 4/1996 | Maldanis et al. | 194/217 |
| 5,516,003 | A | 5/1996 | Hebert | 221/130 |
| 5,529,207 | A | 6/1996 | Oden et al. | 221/67 |
| 5,791,516 | A | 8/1998 | Wittern, Jr. et al. | 221/301 |
| 5,799,823 | A | 9/1998 | Feltrin | 221/298 |
| 5,876,285 | A | 3/1999 | Salour et al. | 463/29 |
| 5,941,921 | A | 8/1999 | Dasys et al. | 701/50 |
| 5,993,117 | A | 11/1999 | Lancaster et al. | 406/3 |
| 5,996,838 | A | 12/1999 | Bayer et al. | 221/75 |
| 6,116,462 | A | 9/2000 | Takamura et al. | 221/241 |
| 6,179,161 | B1 | 1/2001 | Kovens et al. | 221/131 |
| 6,209,868 | B1 | 4/2001 | Norton | 273/118 R |
| 6,227,407 | B1 | 5/2001 | Simeri et al. | 221/254 |
| 6,302,293 | B1 | 10/2001 | Wittern, Jr. et al. | 221/92 |
| 6,392,373 | B1 | 5/2002 | Glasgow et al. | 318/430 |
| 6,409,045 | B1 | 6/2002 | Lauer | 221/124 |
| 6,513,887 | B2 | 2/2003 | Paczkowski et al. | 312/45 |
| 6,550,638 | B1 | 4/2003 | Mochida | 221/124 |

FOREIGN PATENT DOCUMENTS

| | | | |
|---|---|---|---|
| JP | 04077894 A | 3/1992 | G07F/11/58 |
| WO | PCT/US03/024897 | 8/2003 | |

OTHER PUBLICATIONS

International Search Report for PCT/US03/24773 filed Aug. 7, 2003.

*Primary Examiner*—Kenneth Noland
(74) *Attorney, Agent, or Firm*—Baker Botts L.L.P.

(57) ABSTRACT

The disclosed invention is a dispensing apparatus and method for dispensing product from a vending machine. The invention employs a product vend detector to sense when products are dispensed. A controller compares the occurrences of products actually dispensed to the product depth setting assigned to a product dispensing assembly. When vend-completed signals do not match the assigned product setting, the controller initiates a learning mode to determine the actual product depth of the product dispensing assembly and resets the product depth setting to the correct value. The present invention eliminates the need for manual adjustments and eliminates the need to use additional electromechanical components, such as timing cams and switches that are normally used by prior product dispensing systems.

16 Claims, 4 Drawing Sheets

SELF-LEARNING DEPTH LOGIC FOR MULTI-DEPTH VENDOR CONTROL

CROSS-REFERENCE TO RELATED APPLICATIONS

This application claims the benefit of provisional U.S. Application Ser. No. 60/401,958, filed Aug. 8, 2002, and titled "Self-Learning Depth Logic for Multi-Depth Vendor Control," which is incorporated herein by reference in its entirety.

TECHNICAL FIELD OF THE INVENTION

This invention relates in general to the field of vending machines, and more particularly, to a system and method for determining the various depth settings of the product dispensing mechanism in a vending machine.

BACKGROUND OF THE INVENTION

Vending machines are widely used to dispense beverages, food, and other perishable and nonperishable goods. The products dispensed by vending machines come in various sizes. At present, vending machines can be manually adjusted to accommodate the various product sizes by manually selecting predetermined depth settings for the product dispensing mechanisms of the vending machine.

Generally, many vending machines, particularly those that dispense beverages, have column walls or partitions between which the individual bottles or cans and the like are stacked in a vertical column. At the bottom of each stack is a dispensing mechanism that dispenses a selected bottle or can after receipt of payment by the vending machine.

One type of dispensing mechanism is known as a bucket type mechanism. Bucket type dispensing mechanisms have a partial cylindrical shape that accommodates within it a row of bottles or cans that is positioned laterally relative to the length of the cylinder. A portion of the circumference of the cylinder, however, is open, therefore allowing the bottles or cans to enter into, and exit from the bucket at various stages of the vend cycle.

In operation, a motor or other rotational means rotates the bucket about its axis. A gauging means, appropriately located below the bucket, is used to create steps of various sizes, which generally correspond to the length of the individual cans or bottles being dispensed. The opening in the bucket is of a sufficient size so that when rotated to a certain point, the first bottle or can is free to fall out of the bucket dispenser and into the product chute through which it is dispensed to the customer, while the next-to-vend bottle or can remains in the bucket, held by the next gauging step.

During subsequent vends, the bucket rotates to expose the next bottle or can, allowing it to fall. After all products have been dispensed from the bucket, the dispensing mechanism continues through the reload phase of the vend cycle whereby the next row of products enter the bucket in preparation for the subsequent vending cycles. Thus, products are initially seated within the bucket, but are unseated and dispensed as the bucket rotates.

Typically, it is highly desirable to maximize the number of products that can be stored in the vending machine's product storage compartment, while minimizing the number of product dispensing mechanisms inside each vending machine. Most common vending machines can be configured to various depth settings to accommodate products of various lengths. For example, a vending machine with a product holding stack that can accommodate rows of four cans, can generally be reconfigured to accommodate rows of two bottles (bottles are approximately twice as long as cans).

At present, two common methods are used by vending machines to adjust their product depth settings. The first method is to use cams and switches which can be manually adjusted to vary the number of stopping positions for an individual product dispensing mechanism. The second method is to program the depth setting for each product dispensing mechanism into the vending machine controller (VMC). Programming the VMC is normally achieved by entering the service mode in the VMC program and adjusting the depth setting for each product dispensing mechanism to a number that corresponds to the appropriate product depth. For example, a setting of "1" is for single depth, "2" for double depth, "3" for triple depth, etc.

The current methods for adjusting product depth settings place heavy reliance on the initial, manual selection of a depth setting. If the initial depth settings are set incorrectly (an unfortunate, but common occurrence), the errors leads to undesirable outcomes. Often, operators of the vending machine may not detect the errors and its undesirable outcomes for long periods of time, which result in poor customer satisfaction and operator losses. One type of error occurs when the product depth setting is set to a number higher than the actual product depth. For example, an error occurs when the product depth is set to "4", and the actual product depth is "2" (for double depth bottles). With this type of error, only two products will be successfully dispensed for every four attempts to purchase from the vending machine. The other two attempts will result in the consumers losing their money.

A second type of error occurs when the product depth setting is set to a number lower than the actual product depth. For example, product depth is set to "2", and the actual product depth is "4" (quadruple depth cans). With this type of error, one out of every two attempts to purchase from the vending machine will result in three products being dispensed. The purchaser benefits from the error by receiving three items from the price of one, to the detriment of the vending machine operator.

The errors described above occur frequently in existing vending machines and lead to highly undesirable and costly outcomes for operators of vending machines.

Therefore, there is a need for an invention that allows a vending machine to self-learn the product depth setting of a product dispensing mechanism and automatically self-adjust that setting, thereby avoiding the errors described above.

SUMMARY OF THE INVENTION

It is an object of the present invention to provide an improved method and apparatus for product dispensing in a vending machine.

Another object of the present invention is to provide such a method and apparatus that do not require manual adjustment in order to dispense products of various depths.

Another object of the present invention is to provide such a method and apparatus that do not require timing cams and switches to control the stopping positions of the product dispensing mechanism.

Another object of the present invention is to provide such a method and apparatus that prevent errors wherein more products are dispensed than actually paid for by the customer.

Another object of the present invention is to provide such a method and apparatus that prevent errors wherein less products are dispensed than actually paid for by the customer.

Thus, the present invention achieves these objects in a method and apparatus for determining the appropriate depth setting for the product dispensing mechanism in a vending machine. The apparatus includes a motor driven product dispenser having a gauging means that allows multiple products to sequentially be freed one at a time in accordance with the amount of rotation that the product dispenser travels, a motor controller used to control the product dispenser drive motor, a product delivery chute located below the product dispenser for receiving product as they are freed from the product dispenser and transporting them to a product delivery hopper where they are presented to the consumer, a product vend sensor mounted to the delivery chute to detect when a product has been freed from the product dispenser. Receiving input signals from the product vend sensor, the motor controller detects when a product has been freed from the product dispensing mechanism and determines the appropriate product depth setting for the product dispensing mechanism. Thus, the present invention eliminates the need for manual adjustments to the product dispensing mechanism to accommodate products of various depths.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

The following description and FIGS. 1–4 describe exemplary embodiments of the present invention. One embodiment has a motor driven product dispenser having a product dispensing assembly that allows multiple products to sequentially be freed one at a time in accordance with the amount of rotation that the product dispenser travels, a motor controller used to control the product dispenser drive motor, a product delivery chute located below the product dispenser for receiving products as they are freed from the product dispenser and for transporting products to a product delivery hopper where they are presented to the consumer, a product vend sensor mounted at or near the delivery chute to detect when a product has been freed from the product dispenser and thereby signals the motor controller to stop rotation of the motor before additional products are freed. Thus, the present invention eliminates the need for manual adjustments to the product dispensing mechanism to accommodate products of various depths. Supplied with input signals from product vend sensors, the controller can determine when a product has been freed from the product dispensing mechanism and make the appropriate adjustments to signal the motor controller either to stop rotation of the motor before additional products are freed or to continue to rotate through the reload cycle, as appropriate. The present invention eliminates the need for manual adjustments to the product depth setting and eliminates the need for the timing cams and switches that are normally used by prior product dispensing systems.

Figure 1:
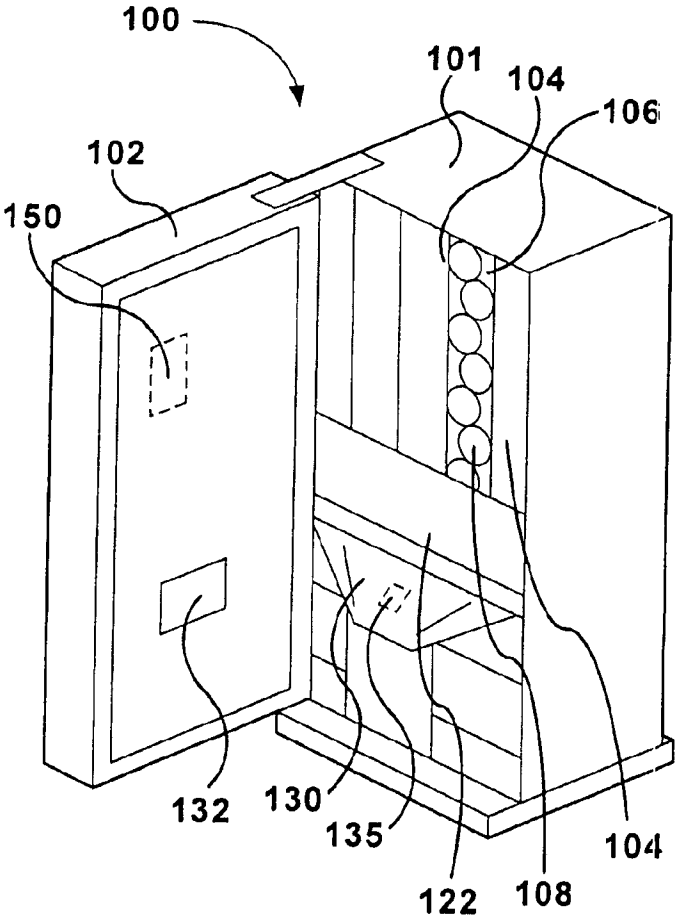
FIG. 1 is a perspective view of a vending machine incorporating the disclosed invention.

FIG. 1 shows the interior of a vending machine 100 having a housing 101 and a door 102 pivotally coupled to the housing. Within housing 101, products 108, such as bottles or cans, are stored vertically in channels 106 formed between successive partitions 104. Products are typically positioned laterally within the channel and stacked on top of one another to form one or more vertical columns as shown in FIG. 1. A product dispensing chute 130 is positioned below the channel 106 to receive products 108 that are dispensed by a product dispensing assembly 200 (FIG. 2) and to deliver them to a location at which they can be retrieved by a customer through an aperture 132 in the vending machine door 102. A product vend detector 135 is located at the product dispensing chute to detect a vend-completed signal, indicating that a product 108 has been successfully dispensed. Product vend detector 135 sends vend-completed signals to the vending machine controller 150, thereby allowing controller 150 to determine whether the depth setting has been set correctly. A front panel 122 (FIGS. 1, 3 and 4) extends across the front side of the lower portion of partitions 104. Positioned behind front panel 122 are dispensing assemblies 200 (FIG. 2).

Figure 2:
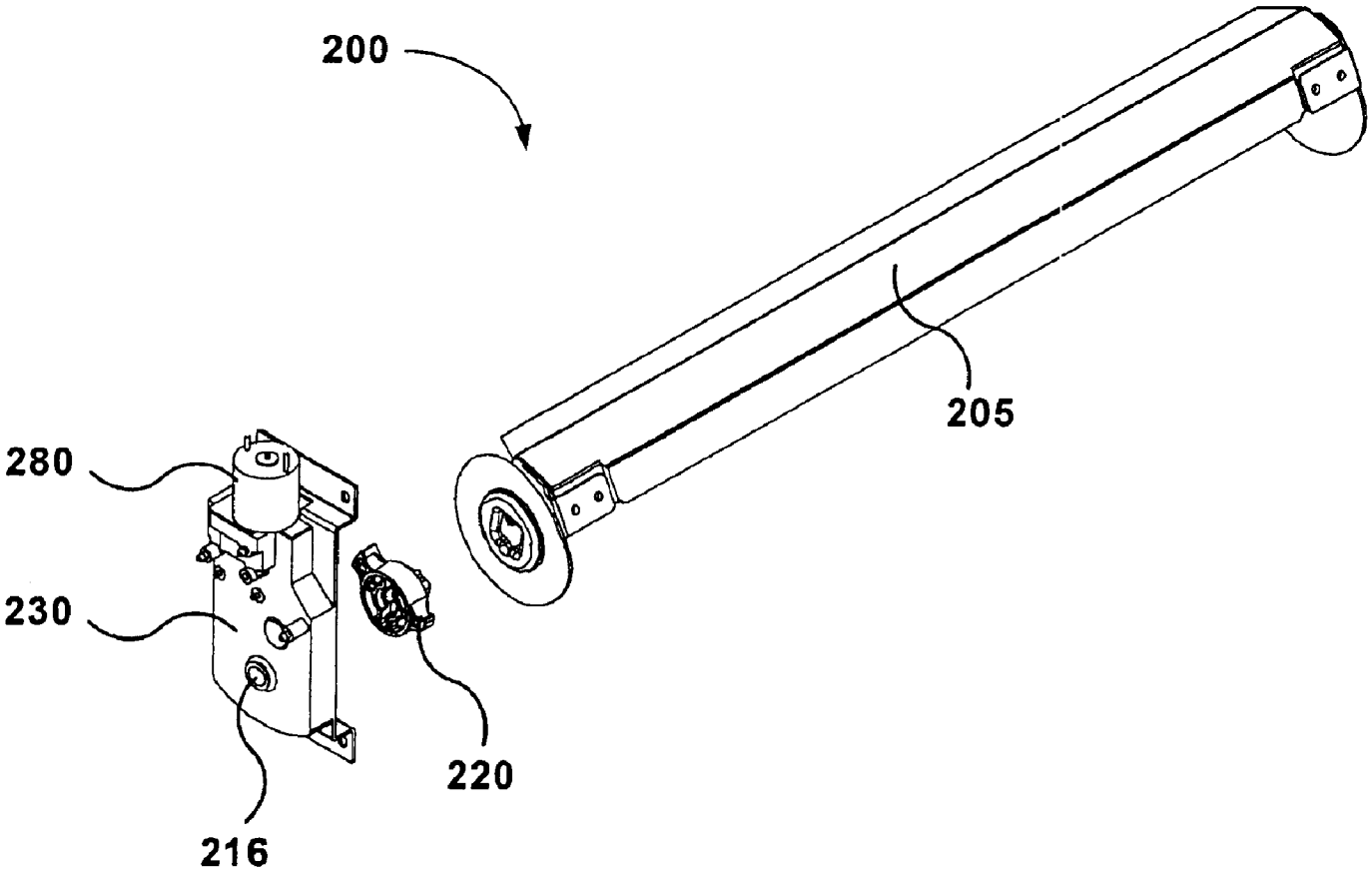
FIG. 2 is a view of components of a product dispensing assembly according to the present disclosure.

FIG. 2 shows the product dispensing assembly 200 used for dispensing products 108 after receipt of payment by the vending machine. Product dispensing assembly 200 includes a dispenser 205 that is positioned substantially horizontally at the bottom of the channel 106 and between partitions 104, and extends laterally along the channel. The dispenser may extend substantially along the length of the channel, or along the portion of the channel in which products are stacked. The dispenser assembly 200 is mounted to front panel 122 and rear panel 422 (FIG. 4) such that it is rotatable. The product dispensing assembly 200 can be controlled by controller 150 to dispense products by the amount of rotation induced upon the dispenser by the motor assembly 230. According to one embodiment, the dispenser is substantially cylindrical in overall shape, but other configurations are also possible.

Moreover, FIG. 2 shows a product dispensing assembly 200 having a motor assembly 230, with a motor 280 that is electrically coupled to a vending machine controller 150 (FIG. 1) for rotating and controlling the rotational position of the dispenser. Motor assembly 230 is fixedly secured to the vending machine, and in one embodiment is mounted on a front side 402 (FIG. 4) of the front panel 122 (FIGS. 1, 3 and 4) and rigidly coupled to the product dispensing assembly 200 by a coupler cam 220. The vending machine controller 150 may be programmed to a value that corresponds to the number of products to be loaded into the product dispenser as previously described. For example, if each row of products 108 stored in channel 106 consists of two beverage containers, then the programmable value of the controller must be set at "2". In the case that each row of products consists of four beverage containers, the programmable value of the controller must be set to "4". The controller 150 also has the ability to keep track of the number of products that have been dispensed during a given vend cycle, and thus knows when the dispenser is empty, thereby allowing the dispenser to continue through a reload cycle in order to prepare the next row of products for subsequent dispensing.

Figure 3:
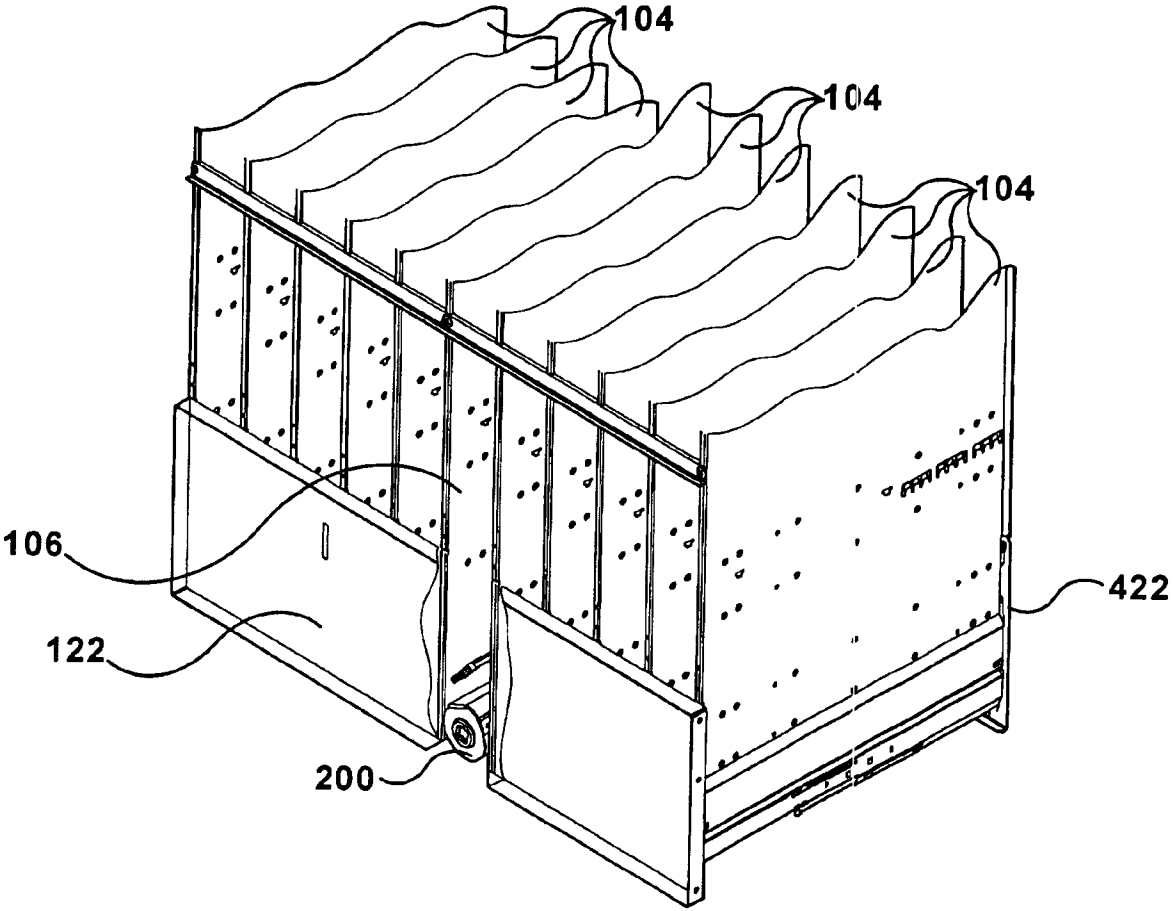
FIG. 3 is a perspective front view of a product dispensing assembly according to the present disclosure removed from a vending machine.

FIG. 3 shows product dispensing assemblies 200 within housing 101 (FIG. 1). Products 108, such as beverage bottles or cans, are stored vertically in channels 106 formed between successive partitions 104. Products are typically positioned laterally within the channel and stacked on top of one another to form one or more vertical columns in channels 106. A product dispensing assembly 200 is positioned between successful partitions 104 and also between front panel 122 and rear panel 422.

Figure 4:
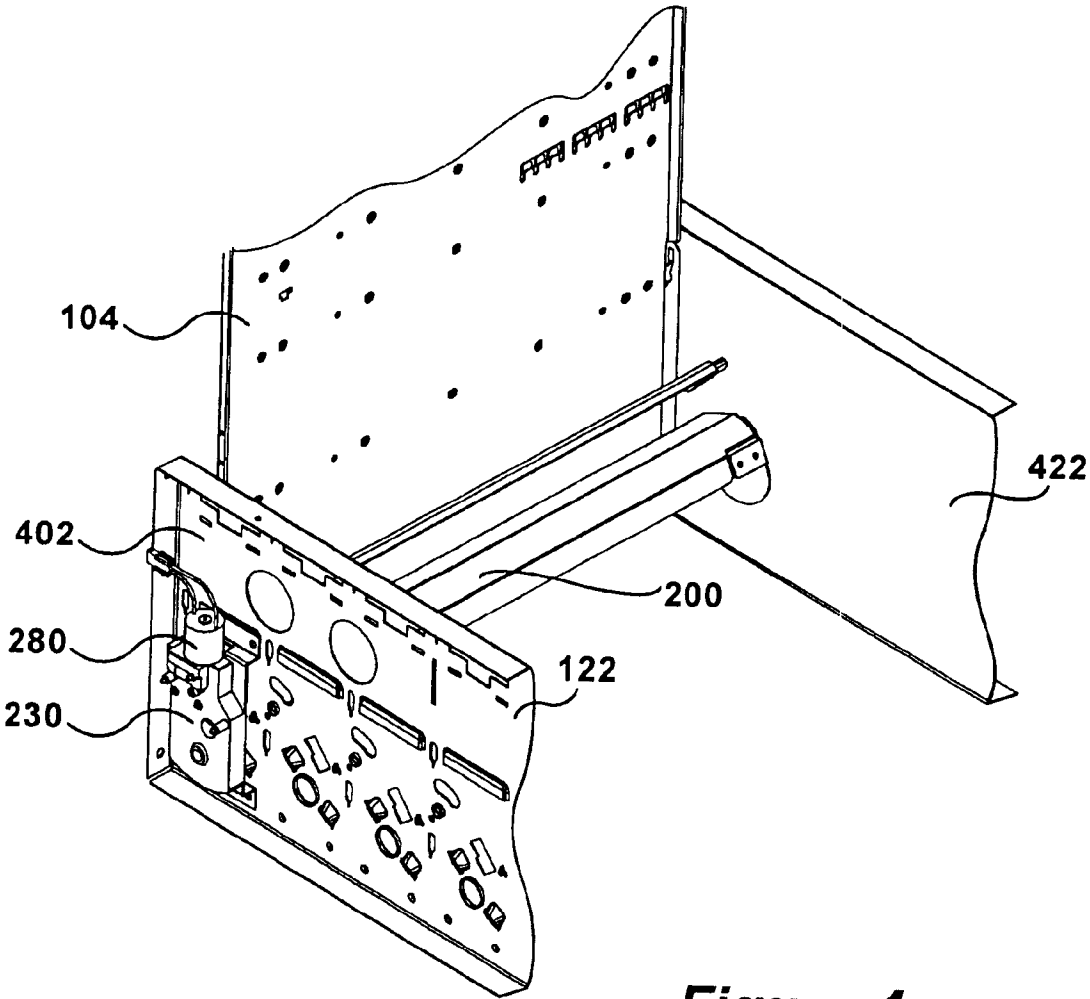
FIG. 4 is a perspective view of a product dispensing assembly and motor assembly mounted on an internal panel of a vending machine.

FIG. 4 shows a view similar to FIG. 3 and also better illustrates the positions of the motor assembly 230 and product dispensing assembly 200.

When the vending machine determines that sufficient payment has been received, and a selection has been made, the process of dispensing a product begins. Controller 150 activates the motor 280 to begin rotating clockwise to thereby also rotate the dispenser 205 and coupling cam 220 to cause a product 108 to drop into the product dispensing chute 130. Next, the vending machine controller 150 receives a vend-completed signal from a product vend detector 135 (FIG. 1). Upon receiving this signal, the motor controller determine whether the product depth setting has be set correctly.

In one embodiment of the present invention, a vending machine is enabled with the ability to automatically adjust its product dispensing mechanism depth setting to allow vending of products of various depth. The vending machine is equipped with a vending machine controller (VMC) that is programmable to control the product dispensing mechanism depth setting. Further, the vending machine uses product vend detectors, such as vibration sensors attached to the product delivery chute, optical sensors located below the product dispensing mechanism, or other types of detectors, to determine when a product is actually dispensed. The vending machine controller 150 may be programmed to specific value for its product depth setting that corresponds to the number of products to be loaded into a product dispenser as previously described.

During a vend cycle, the VMC receives feedback signals in the form of vend-completed signals from the product detection device. If the feedback signal does not match the specific value for the VMC's product depth setting, the VMC enters a learning mode in which the VMC will count the number of products vended during the next "complete" vend cycle of the individual product dispensing mechanism, and then adjusts the depth setting of the product dispensing mechanism to match the number of vended products. A "complete" vend cycle of a product dispensing mechanism is generally defined as including all of the steps required to dispense a row of products through the product dispensing mechanism and the subsequent reload steps required to refill the product dispensing mechanism with the next row of products from the product holding stack.

The operations of the present invention may be illustrated by two examples. First, in the case where the VMC's product depth setting (e.g., "4") is set to value higher than the actual product depth (e.g., "2" for double depth bottles), the first two attempts to purchase products will be successful. Third attempt will yield no product, because no third product exists in the product dispenser during this vend cycle. While the VMC is expecting a vend-completed signal, it will receive none. The absence of a vend-completed signal triggers the learning mode of the VMC to begin counting the number of products vended during the next "complete" vend cycle and to reset the VMC's product depth setting to the new value. In this example, the VMC will count the "2" during the next complete vend cycle and thus will accordingly reprogram the depth setting to "2" for that particular product dispensing mechanism.

In a second example, in the case where the VMC's product depth setting (e.g., "2") is set to a value lower than the actual product depth (e.g., "4" for quadruple depth cans), the second attempt to purchase will yield three products for the price of one. The incorrect depth setting will allow the product dispensing mechanism to operate as if the product dispensing mechanism has vended all products from that row, even though two products remain, and thus the product dispensing mechanism will continue through the reload portion of the vend cycle in order to reload with the next row of products. At the second attempt to purchase, while the VMC is expecting only one vend-completed signal, it will unexpectedly receive two additional vend-completed signals from the product vend detector, which detected the occurrence of the third and fourth products vended. The occurrence of additional vend-completed signals triggers the learning mode of the VMC to begin counting the number of products vended during the next "complete" vend cycle and to reset the VMC's product depth setting to the new value. In this example, the VMC will count "4" during the next complete vend cycle and thus will accordingly reprogram the depth setting to "4" for that particular product dispensing mechanism.

The operations described above are applicable to dispensers that can accommodate one, two, three or more products within the dispenser at one time. It should therefore be understood that variations to the sequences and description above are easily accomplished to accommodate variations in product numbers.

In one embodiment, the vending machine includes a product vend detector that senses when product vending has occurred and accordingly signals the motor controller. It should be noted that there are many types of detectors and sensors that may be used for sensing a vend-completed signal at the product chute and product dispenser. For example, in other embodiments, the detector may consist of a vibration sensor attached to the product chute 135, an optical sensor mounted below the product dispenser 205, or other similar devices.

Although the invention has been described in detail with respect to a bucket type dispensing mechanism, it should be noted that the present invention is adaptable for use with other common types of dispensing mechanisms. Further, although the present invention has been described in detail, it should be understood that various changes, substitutions and alterations can be made hereto without departing from the spirit and scope of the invention as defined by the appended claims.

What is claimed is:

1. A vending machine, comprising:

a housing for storing products to be dispensed;

a product dispensing assembly comprising a dispenser for holding and dispensing a product, an actual product depth for the dispenser;

a product dispensing mechanism depth setting for the product dispensing assembly;

a product vend detector comprising a means to sense when the product is dispensed; and a controller electrically coupled to the product dispensing assembly, wherein the controller receives input signals from the product vend detector and programmable to adjust the product dispensing mechanism depth setting to match the actual product depth.

2. The vending machine according to claim 1, wherein the controller compares the input signals sent by the product vend detector to the product dispensing mechanism depth setting for the product dispensing assembly to determine whether the controller will enter a learning mode to adjust the depth setting.

3. The vending machine according to claim 2, wherein the learning mode is entered when the input signals sent by the product vend detector do not match the depth setting for the product dispensing assembly.

4. The vending machine according to claim 3, wherein when in the learning mode, the controller counts the number of products vended during a complete vend cycle of the product dispensing mechanism.

5. The vending machine according to claim 4, wherein the controller adjusts the depth setting of the product dispensing mechanism to match the number or products vended during the complete vend cycle.

6. The vending machine according to claim 5, further comprising a product chute for receiving the product when dispensed by the dispenser; and wherein the product vend detector is positioned substantially at the product chute.

7. The vending machine according to claim 6, wherein the product vend detector is an impact sensor.

8. The vending machine according to claim 6, wherein the product vend detector is an optical sensor.

9. The vending machine according to claim 5, wherein the product vend detector is positioned substantially below the product dispenser.

10. The vending machine according to claim 9, wherein the product vend detector is an impact sensor.

11. The vending machine according to claim 9, wherein the product vend detector is an optical sensor.

12. A method for dispensing products from a vending machine, comprising the steps of:

storing products in a product dispensing assembly having an actual product depth;

setting a first product depth setting for a product dispensing assembly;

sensing input signals when products are dispensed;

transmitting the input signals from a product vend detector to a controller;

comparing the input signals to the first product depth setting; and adjusting the first product depth setting for a product dispensing assembly to a second product depth setting that matches the actual product depth.

13. The method according to claim 12, wherein the controller compares the input signals transmitted by the product vend detector to the first product depth setting for the product dispensing assembly to determine whether the controller will enter a learning mode to adjust the depth setting.

14. The method according to claim 13, wherein the learning mode is entered when the input signals sent by the product vend detector do not match the depth setting for the product dispensing assembly.

15. The vending machine according to claim 14, wherein when in the learning mode, the controller counts the number of products vended during a complete vend cycle of the product dispensing mechanism.

16. The vending machine according to claim 15, wherein the controller adjusts the depth setting of the product dispensing mechanism to match the number or products vended during the complete vend cycle.

* * * * *